US010400689B2

(12) United States Patent
Iriyama et al.

(10) Patent No.: US 10,400,689 B2
(45) Date of Patent: Sep. 3, 2019

(54) FUEL TANK SYSTEM AND CONTROL METHOD OF FUEL TANK SYSTEM

(71) Applicant: TOYOTA JIDOSHA KABUSHIKI KAISHA, Toyota-shi, Aichi-ken (JP)

(72) Inventors: Yojiro Iriyama, Toyota (JP); Chiaki Kataoka, Nagakute (JP); Masanobu Shinagawa, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 84 days.

(21) Appl. No.: 15/846,685

(22) Filed: Dec. 19, 2017

(65) Prior Publication Data

US 2018/0195445 A1 Jul. 12, 2018

(30) Foreign Application Priority Data

Jan. 11, 2017 (JP) ..... 2017-002956

(51) Int. Cl.
*F02M 25/08* (2006.01)
*F02D 41/00* (2006.01)

(52) U.S. Cl.
CPC ..... *F02D 41/004* (2013.01); *F02D 41/003* (2013.01); *F02M 25/089* (2013.01); *F02M 25/0836* (2013.01); *F02M 25/0854* (2013.01); *F02D 2200/0602* (2013.01)

(58) Field of Classification Search
CPC ..... F02D 41/004; F02D 41/003; F02D 2200/0602; F02M 25/089; F02M 25/0854; F02M 25/0836
USPC ..... 123/516, 518, 519, 520; 73/114.39; 701/107
See application file for complete search history.

(56) References Cited

U.S. PATENT DOCUMENTS 9,341,538 B2 * 5/2016 Horiba ..... G01M 3/2876
10,138,827 B2 * 11/2018 Dudar ..... F02D 41/004
2017/0292476 A1 * 10/2017 Dudar ..... F02M 25/089

FOREIGN PATENT DOCUMENTS

JP 2004-156492 A 6/2004
JP 2015-190347 A 11/2015

* cited by examiner

*Primary Examiner* — Hai H Huynh
(74) *Attorney, Agent, or Firm* — Oliff PLC

(57) ABSTRACT

A fuel tank system includes a fuel tank, a canister, a first path, a pump, a switching device, a reference path, a first on-off valve, a second on-off valve, a third on-off valve, a pressure sensor, and a control device configured to control the pump, the switching device, the first on-off valve, the second on-off valve, and the third on-off valve and determine a system state based on a pressure measured by the pressure sensor.

8 Claims, 13 Drawing Sheets

FUEL TANK SYSTEM AND CONTROL METHOD OF FUEL TANK SYSTEM

INCORPORATION BY REFERENCE

The disclosure of Japanese Patent Application No. 2017-002956 filed on Jan. 11, 2017 including the specification, drawings and abstract is incorporated herein by reference in its entirety.

BACKGROUND

1. Technical Field

The present disclosure relates to a fuel tank system and a control method of a fuel tank system.

2. Description of Related Art

In Japanese Unexamined Patent Application Publication No. 2004-156492 (JP 2004-156492 A), an evaporative fuel processing device of an internal combustion engine in which a sealing valve is provided between a fuel tank and a canister and the sealing valve is maintained in a closed state while a vehicle is parked is described.

SUMMARY

In a configuration in which a sealing valve (on-off valve) is provided in a vent line between a fuel tank and a canister, for example, it is possible to detect a leakage in a fuel tank system by operating a pump provided in an atmosphere communication hole of the canister, opening the sealing valve, and measuring a tank internal pressure of the fuel tank. In addition, it is possible to detect a leakage in the canister by operating the pump and closing the sealing valve.

However, in the configuration described above, two internal pressure sensors, that is, the internal pressure sensor of the fuel tank and the internal pressure sensor of the canister are needed. Therefore, it is desirable to simplify the structure.

The present disclosure provides a fuel tank system and a control method of a fuel tank system capable of determining a state of the fuel tank system with a simple structure.

A first aspect of the present disclosure relates to a fuel tank system including a fuel tank configured to store a fuel; a canister configured to cause an evaporative fuel to adsorb or desorb using an adsorbent; a first path configured to be connected to the canister and cause an inside of the canister to communicate with an atmosphere; a pump configured to be disposed in a second path connected to the canister and apply a pressure to the canister; a switching device configured to be selectively switched between an atmosphere communication state in which the canister communicates with the atmosphere using the first path and a pressure introduction state in which the pressure of the pump is applied to the canister using the second path and the pump; a reference path configured to be connected to the canister and the pump, have a resistance portion having a locally high flow resistance, and cause an air to be introduced into the canister through the resistance portion by driving the pump when the switching device is switched to the atmosphere communication state; a first on-off valve configured to be disposed in a vent line that causes the fuel tank and the canister to communicate with each other and open and close the vent line; a second on-off valve configured to be disposed in the vent line at a position closer to the canister than the first on-off valve and open and close the vent line; a third on-off valve configured to be disposed in a communication path that causes the vent line between the first on-off valve and the second on-off valve and the reference path to communicate with each other and open and close the communication path; a pressure sensor disposed in the vent line between the first on-off valve and the second on-off valve or in the communication path closer to the vent line than the third on-off valve; and a control device configured to control the pump, the switching device, the first on-off valve, the second on-off valve, and the third on-off valve and determine a system state based on a pressure measured by the pressure sensor.

According to the first aspect of the present disclosure, since the internal pressure of the fuel tank is applied to the pressure sensor in the state in which the first on-off valve is open and the second on-off valve and the third on-off valve are closed, the presence or absence of a leakage in the fuel tank can be determined. In addition, in the fuel tank system, the pressure at the time when the air is introduced through the resistance portion can be obtained as a reference pressure by opening the third on-off valve and driving the pump by switching the switching device to the reference path. In addition, the presence or absence of a leakage in the canister can be determined by opening the second on-off valve, closing the first on-off valve and the third on-off valve, introducing a pressure to the canister by causing the switching device to enter the pressure introduction state, and comparing the pressure of the canister measured by the pressure sensor to the reference pressure.

As described above, with the fuel tank system according to the first aspect of the present disclosure, the state of the fuel tank system (the presence or absence of a leakage in the canister and the fuel tank) can be determined with a simple structure provided with the single pressure sensor.

In the fuel tank system according to the first aspect of the present disclosure, the first on-off valve, the second on-off valve, and the third on-off valve may be configured as an integrated valve that is integrated.

Since the first on-off valve, the second on-off valve, and the third on-off valve are integrated by the integrated valve, the structure of the fuel tank system can be simplified.

A second aspect of the present disclosure relates to a control method of the fuel tank system of the first aspect. The control method includes: by the control device, measuring an internal pressure of the fuel tank using the pressure sensor by controlling the first on-off valve to be in an open state and controlling the second on-off valve and the third on-off valve to be in a closed state; and by the control device, measuring an internal pressure of the canister using the pressure sensor by controlling the second on-off valve to be in an open state, controlling the first on-off valve to be in a closed state, controlling the switching device to be switched to the pressure introduction state, and controlling the pump to be driven.

According to the second aspect of the present disclosure, a configuration in which the internal pressure of the fuel tank or the internal pressure of the canister is measured using the single pressure sensor by controlling the opening and closing of the first on-off valve, the second on-off valve, and the third on-off valve can be realized.

In the control method according to the second aspect of the present disclosure, the control method may further include, by the control device, controlling opening and closing of the second on-off valve in a state in which the first on-off valve is open and the third on-off valve is closed at the time when the fuel tank is refueled and at the time when a vehicle on which the fuel tank system is provided is parked or traveling.

According to the second aspect of the present disclosure, it is possible to allow the fuel tank system to be in an appropriate state solely by controlling the second on-off valve at the time when the fuel tank is refueled and at the time when the vehicle is parked and traveling. For example, at the time when the vehicle is parked, a sealed state in which the fuel tank does not communicate with the canister can be realized by closing the second on-off valve. At the time of traveling, a state in which the internal pressure of the fuel tank does not excessively increase can be realized by appropriately opening and closing the second on-off valve. At the time when the fuel tank is refueled, the internal pressure of the fuel tank can be appropriately decreased by opening the second on-off valve, and thus moving gas in the fuel tank to the canister.

In the control method according to the second aspect of the present disclosure, the control method may further include, by the control device, controlling the pump to be driven by causing the switching device to enter the atmosphere communication state in a state in which the second on-off valve and the third on-off valve are closed, and determining failure in a case where a pressure change occurs at a predetermined time.

According to the second aspect of the present disclosure, in a case where the pump is driven by causing the switching device to enter the atmosphere communication state in a state in which the second on-off valve and the third on-off valve are closed, when there is opening failure in the third on-off valve, the pressure of the pump is applied to the pressure sensor, and thus a measurement value is changed. Therefore, the presence or absence of opening failure in the third on-off valve can be determined by detecting the presence or absence of the pressure change.

In the control method according to the second aspect of the present disclosure, the control method may further include, by the control device, controlling the switching device to enter the atmosphere communication state in a state in which the first on-off valve and the third on-off valve are closed and the second on-off valve is open, and determining failure in a case where there is no pressure change at a predetermined time.

According to the second aspect of the present disclosure, since the second on-off valve is open in the state in which the first on-off valve and the third on-off valve are closed, the internal pressure of the canister is applied to the pressure sensor. When there is closing failure in the second on-off valve, there is no change in the measured pressure at a predetermined time. Therefore, the closing failure in the second on-off valve can be determined.

In the control method according to the second aspect of the present disclosure, the control method may further include, by the control device, controlling the pump to be driven by causing the switching device to enter the pressure introduction state in a state in which the first on-off valve and the third on-off valve are closed and the second on-off valve is open, and determining failure in a case where a gradient of the pressure change at the predetermined time is smaller than a predetermined gradient.

According to the second aspect of the present disclosure, since the first on-off valve and the third on-off valve are closed and the second on-off valve is open, the internal pressure of the canister is applied to the pressure sensor. When any one of an abnormality in the atmosphere communication state of the switching device, opening failure in the first on-off valve, and a leakage in the canister is present, the gradient of the pressure change at the predetermined time while the pressure is applied due to the driving of the pump becomes smaller than a predetermined gradient. Therefore, the presence or absence of any one of an abnormality in the atmosphere communication state of the switching device, opening failure in the first on-off valve, and a leakage in the canister can be determined.

In the control method according to the second aspect of the present disclosure, the control method may further include, by the control device, controlling the pump to be stopped by switching the switching device to the pressure introduction state in a state in which the first on-off valve and the second on-off valve are open, and determining failure in a case where there is no pressure change at a predetermined time.

According to the second aspect of the present disclosure, since the first on-off valve and the second on-off valve are open, the pressure of the entire fuel tank and the canister is applied to the pressure sensor. In addition, since the switching device is switched to the pressure introduction state and the pump is stopped, when there is closing failure in the first on-off valve, a pressure change measured by the pressure sensor does not occur at a predetermined time. Therefore, the presence or absence of failure in the first on-off valve can be determined.

According to the aspects of the present disclosure, the state of the fuel tank system can be determined with a simple structure.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

A fuel tank system 22 of an embodiment of the present disclosure will be described with reference to the drawings.

Figure 1:
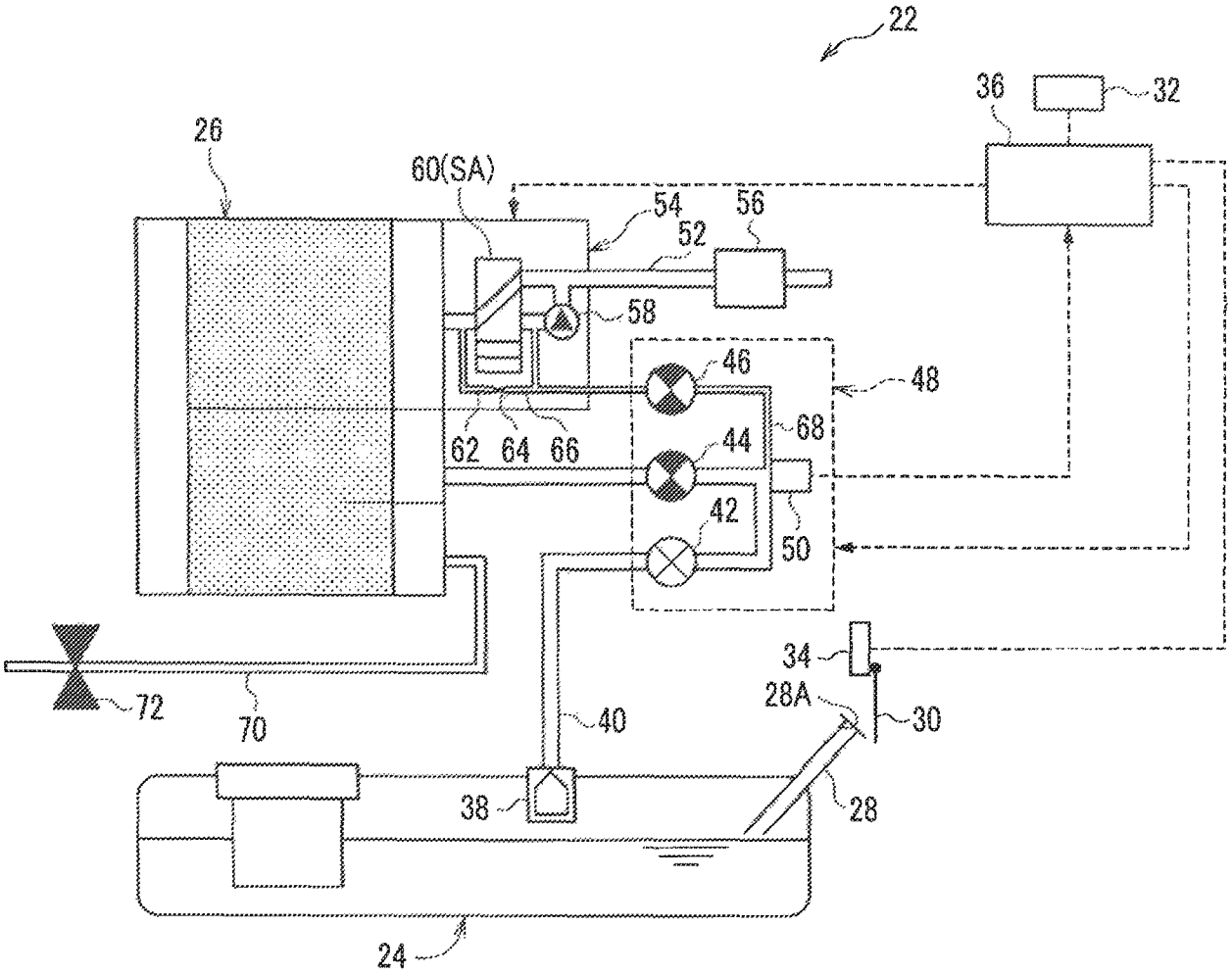
FIG. 1 is a configuration diagram illustrating a fuel tank system of an embodiment in a state at the time when a vehicle is parked.

As illustrated in FIG. 1, the fuel tank system 22 has a fuel tank 24 and a canister 26. The fuel tank 24 can store fuel therein. The fuel tank 24 is provided with an inlet pipe 28, and a refueling nozzle (not illustrated) can be inserted into a refueling port 28A at the upper end of the inlet pipe 28 to refuel the fuel tank 24.

In a vehicle provided with the fuel tank system 22, a lid 30 is provided further outward of the vehicle than the refueling port 28A. The lid 30 is normally locked in a closed position by a lid opener 34 in an OFF state. When a refueling switch 32 enters an ON state at the time of refueling and an instruction to start refueling is input, information of the start of refueling is sent to a control device 36 (details will be described later). In addition, the control device 36 allows the lid opener 34 to be in an ON state. The lid opener 34 in the ON state moves the lid 30 to an open position. Accordingly, it is possible to remove a cap from the refueling port 28A and refuel the fuel tank 24.

An adsorbent where evaporative fuel adsorbs or desorbs, such as activated carbon, is stored in the canister 26.

A full tank regulation valve 38 which is closed when the fuel reaches a predetermined full tank level is provided in the fuel tank 24. The full tank regulation valve 38 and the canister 26 communicate with each other through a vent line 40. In a state in which the level of the fuel in the fuel tank 24 has not reached the full tank level, since the full tank regulation valve 38 is open, gas in the fuel tank 24 can move to the canister 26 through the vent line 40. When the liquid level in the fuel tank 24 reaches the full tank level, the full tank regulation valve 38 is closed, so that the gas in the fuel tank 24 cannot move to the canister 26. In this state, when the fuel tank 24 is further refueled, the level of the supplied fuel rises through the inlet pipe 28 and reaches the refueling nozzle, and the refueling is stopped by an automatic stop mechanism of the refueling nozzle.

The vent line 40 is provided with a first on-off valve 42 and a second on-off valve 44 from the fuel tank 24 side. The first on-off valve 42 and the second on-off valve 44 open and close the vent line 40. The first on-off valve 42 and the second on-off valve 44 are controlled by the control device 36.

The vent line 40 is provided with a pressure sensor 50 between the first on-off valve 42 and the second on-off valve 44. Pressure data measured by the pressure sensor 50 is sent to the control device 36. The pressure sensor 50 of the embodiment is a relative pressure sensor (gauge pressure sensor), and can measure the atmospheric pressure and a pressure at a part of the vent line 40 between the first on-off valve 42 and the second on-off valve 44 with respect to the atmospheric pressure.

An atmosphere communication pipe 52 which causes the inside of the canister 26 to communicate with the atmosphere is connected to the canister 26. The atmosphere communication pipe 52 is provided with a switching member 54 and an air filter 56 from the canister 26 side. The air filter 56 removes foreign matter from gas flowing into the canister 26 through the atmosphere communication pipe 52.

Figure 9:
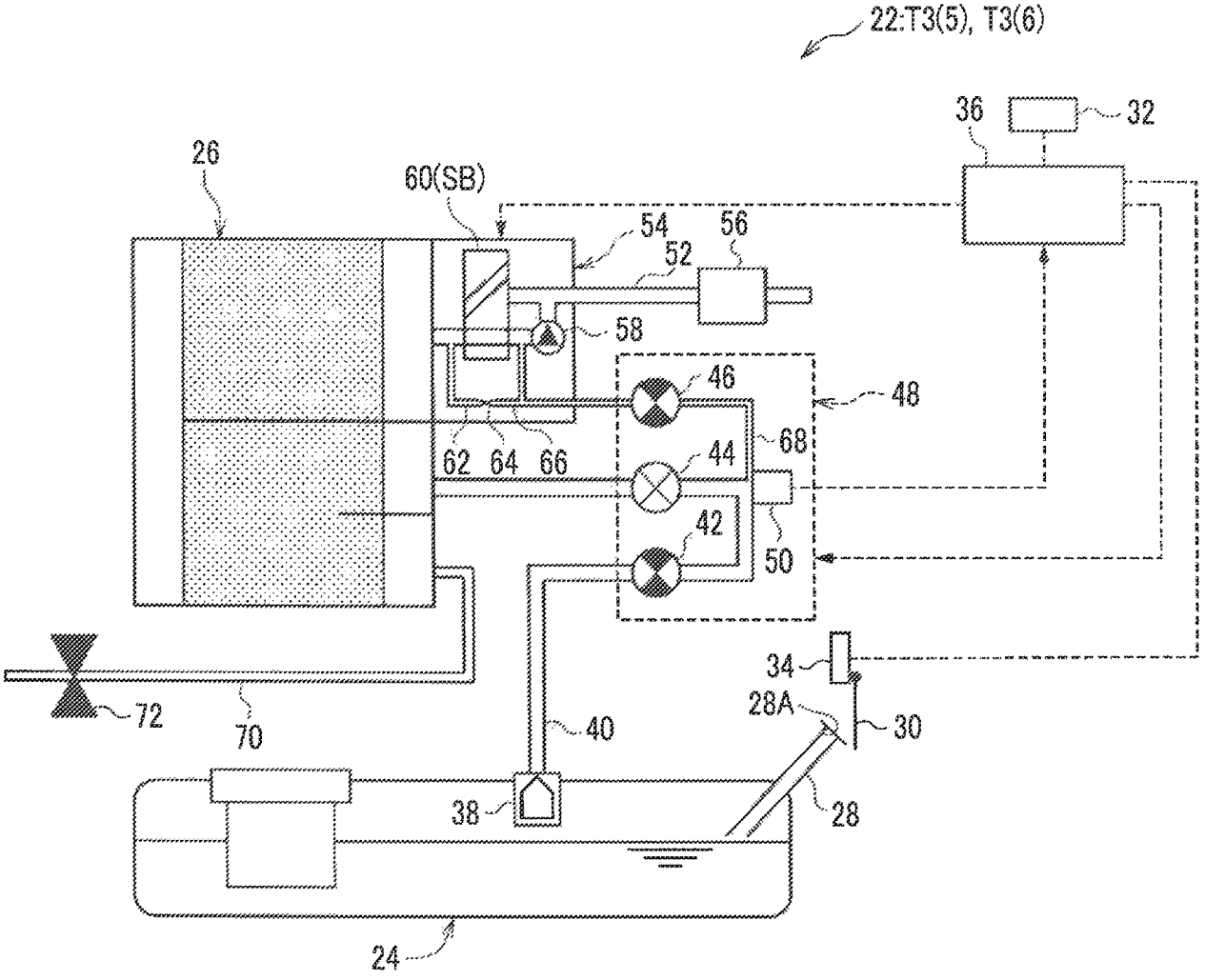
FIG. 9 is a configuration diagram illustrating the fuel tank system of the embodiment in a state at the time of state determination.
Figure 10:
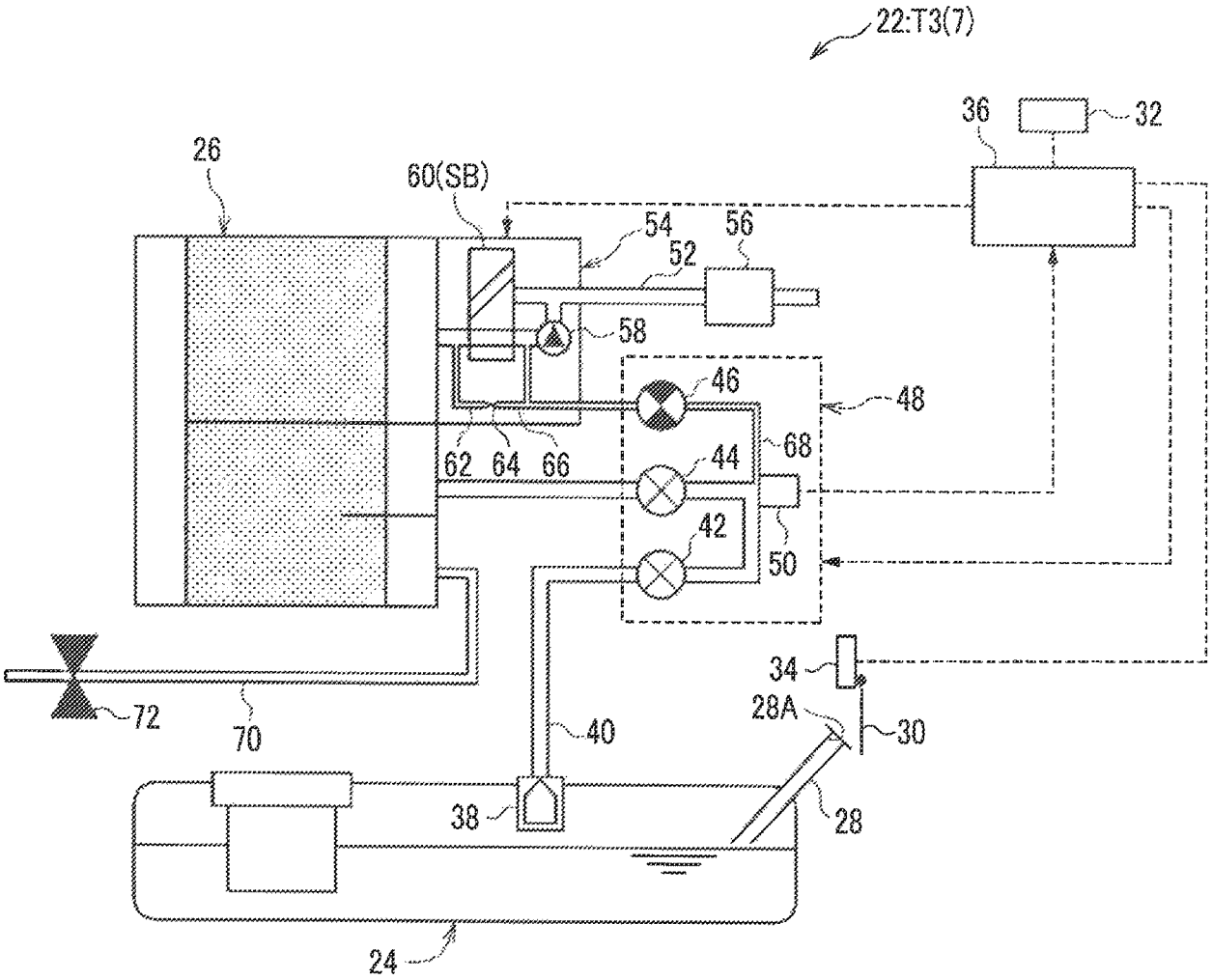
FIG. 10 is a configuration diagram illustrating the fuel tank system of the embodiment in a state at the time of state determination.
Figure 11:
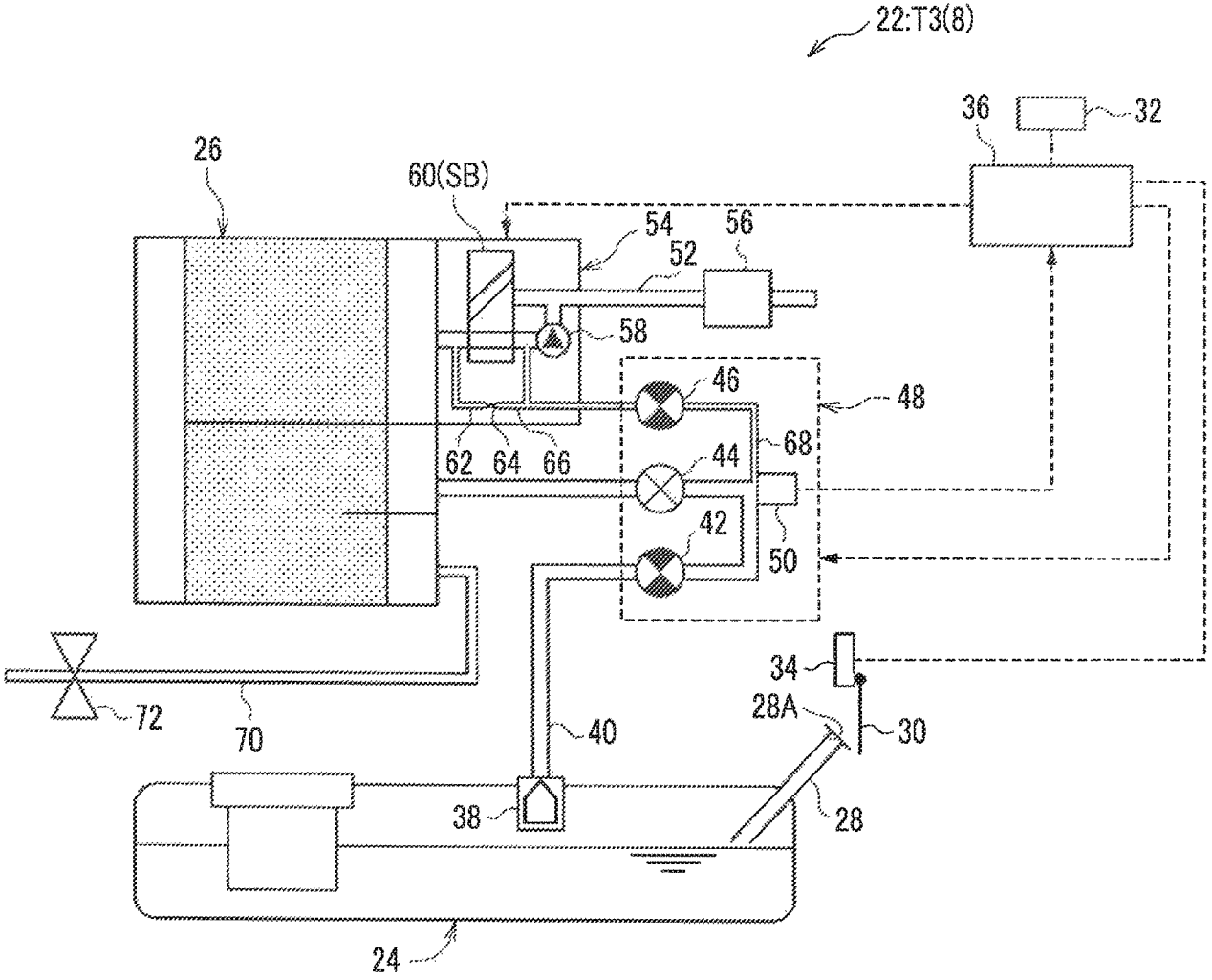
FIG. 11 is a configuration diagram illustrating the fuel tank system of the embodiment in a state at the time of state determination.
Figure 12:
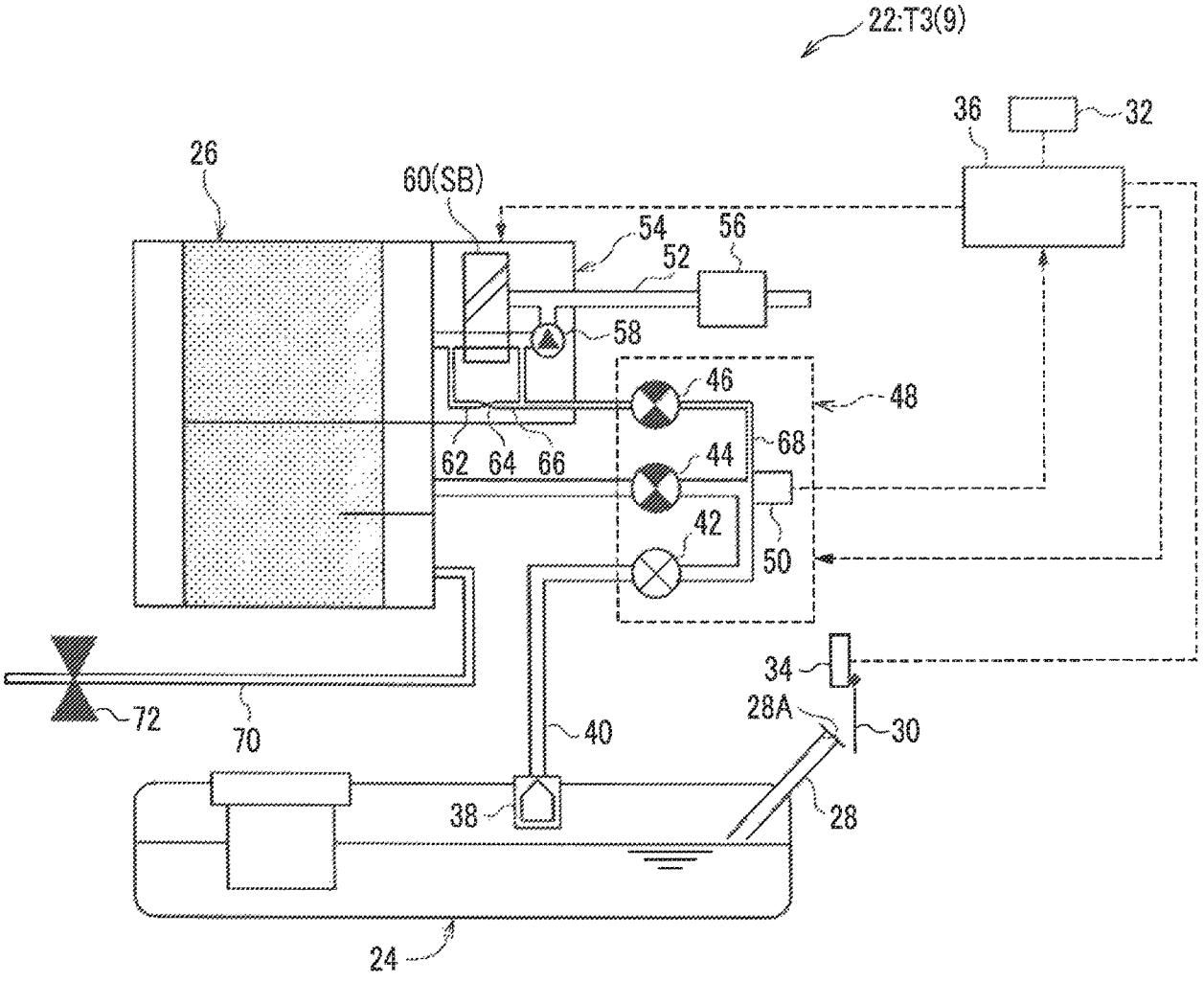
FIG. 12 is a configuration diagram illustrating the fuel tank system of the embodiment in a state at the time of state determination.
Figure 13:
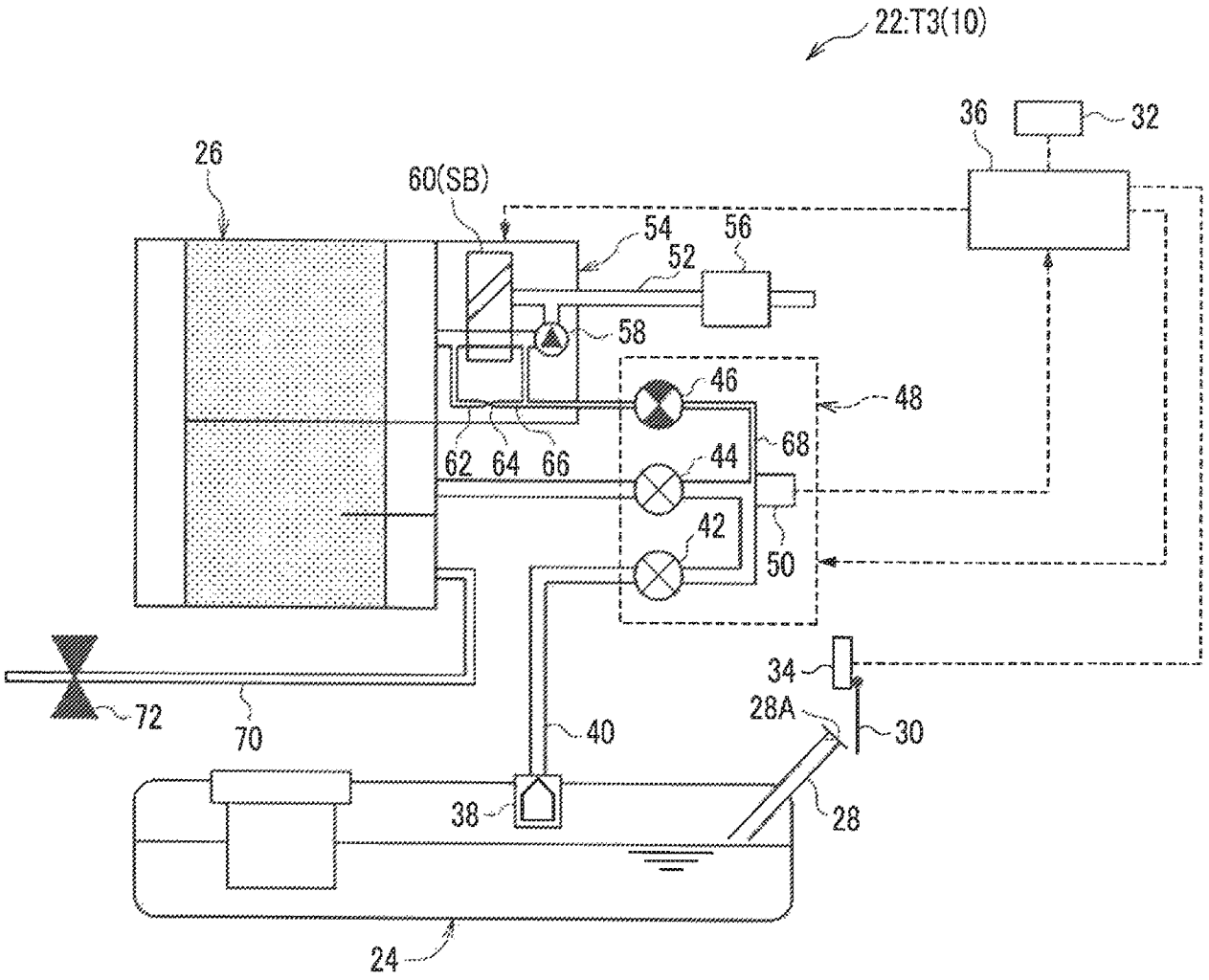
FIG. 13 is a configuration diagram illustrating the fuel tank system of the embodiment in a state at the time of state determination.

The switching member 54 has a pump 58, a switching valve (an example of a switching device) 60, and a bypass path 62. The switching valve 60 can be switched between an atmosphere communication state SA in which the canister 26 communicates with the atmosphere without passing through the pump 58 as illustrated in FIG. 1 and a negative pressure introduction state SB in which communication from the canister 26 through the pump 58 is achieved as illustrated in FIG. 9.

When the switching valve 60 is in the atmosphere communication state SA, the canister 26 communicates with the atmosphere through the atmosphere communication pipe 52. Contrary to this, when the switching valve 60 is in the negative pressure introduction state SB, in a case where the pump 58 is driven, a negative pressure can be applied to the canister 26. In the embodiment, the configuration in which a negative pressure is generated by driving the pump 58 is adopted. However, a configuration in which a positive pressure is generated by driving the pump 58 may also be adopted. That is, as the pump 58, it is possible to use a pump that generates a negative pressure or a pump that generates a positive pressure.

An orifice 64 (for example, 0.5 mm in diameter) is provided in the bypass path 62. The orifice 64 is a part where the flow resistance of a fluid flowing therein is locally high and is an example of a resistance portion.

In addition, the bypass path 62 bypasses the switching valve 60. Therefore, when the switching valve 60 is in the atmosphere communication state SA, in a case where the pump 58 is driven, the air can be introduced from the atmosphere communication pipe 52 through the bypass path 62. However, since the orifice 64 has a locally high flow resistance, a predetermined resistance against the introduction of the air due to the driving of the pump 58 is generated. A part of the bypass path 62 closer to the pump 58 side than the orifice 64 is a reference path 66 at a predetermined negative pressure (hereinafter, referred to as a reference pressure P4).

The switching member 54 (the state of the switching valve 60 and the driving of the pump 58) is controlled by the control device 36.

The vent line 40 at a position between the first on-off valve 42 and the second on-off valve 44 and the reference path 66 communicate with each other through a communication path 68. The communication path 68 is provided with a third on-off valve 46. The third on-off valve 46 opens and closes the communication path 68. The third on-off valve 46 is controlled by the control device 36. The pressure sensor 50 may also be provided between the third on-off valve 46 and a part of the communication path 68 connected to the vent line 40.

In the embodiment, as illustrated in FIG. 1, an integrated valve 48 is provided, and the integrated valve 48 has a structure including the first on-off valve 42, the second on-off valve 44, and the third on-off valve 46. In other words, the structures of the first on-off valve 42, the second on-off valve 44, and the third on-off valve 46 are integrated as one body by the integrated valve 48. As described above, by integrating the first on-off valve 42, the second on-off valve 44, and the third on-off valve 46, the structure of the fuel tank system 22 is simplified.

A purge pipe 70 that communicates with an engine (not illustrated) is connected to the canister 26. The purge pipe 70 is provided with a purge valve 72. The purge valve 72 opens and closes the purge pipe 70. The purge valve 72 is controlled by the control device 36.

When the engine is driven in a state in which the purge valve 72 is open, a negative pressure of the engine can be applied to the canister 26. At this time, when the switching member 54 is in the atmosphere communication state, the air is introduced into the canister 26 from the atmosphere communication pipe 52. In addition, the evaporative fuel adsorbed onto the adsorbent of the canister 26 can desorb. The desorbed evaporative fuel moves to the engine due to the negative pressure from the engine.

Next, a control method of the fuel tank system 22 of the embodiment will be described. Each control method described below is an example of the control method of the fuel tank system 22, and the operation of the fuel tank system 22 is not limited to the following.

At the time of parking, traveling, and refueling as described below, unless otherwise specified, a state in which the first on-off valve 42 is in an open state, the third on-off valve 46 is in a closed state, and the switching valve 60 is in the atmosphere communication state is adopted. Hereinafter, the atmosphere communication state of the switching valve 60 is referred to as an "OFF state", and the negative pressure introduction state is referred to as an "ON state".

At Time of Parking

The control method of the fuel tank system 22 at the time when the vehicle is parked will be described with reference to FIG. 1.

At the time of parking, in the fuel tank system 22, the control device 36 opens the first on-off valve 42 and closes the second on-off valve 44 and the third on-off valve 46. Furthermore, the control device 36 allows the switching valve 60 to be in the OFF state.

Since the second on-off valve 44 is closed, gas in the fuel tank 24 does not move to the canister 26. At the time of parking, even when evaporative fuel is generated in the fuel tank 24, the evaporative fuel does not adsorb onto the adsorbent of the canister 26.

In addition, since the first on-off valve 42 is open, the pressure sensor 50 can measure the internal pressure of the fuel tank 24. For example, in a case where the internal pressure of the fuel tank 24 becomes higher than a predetermined threshold, the control device 36 can perform control to open the second on-off valve 44. In addition, even in a case where a valve that is mechanically opened when a pressure higher than the threshold is applied is used as the second on-off valve 44, the valve is opened when the internal pressure of the fuel tank 24 becomes higher than the predetermined threshold. Accordingly, an excessive increase in the internal pressure of the fuel tank 24 can be suppressed, and there is no need to unnecessarily increase the strength of the fuel tank 24.

At Time of Traveling

Figure 2:
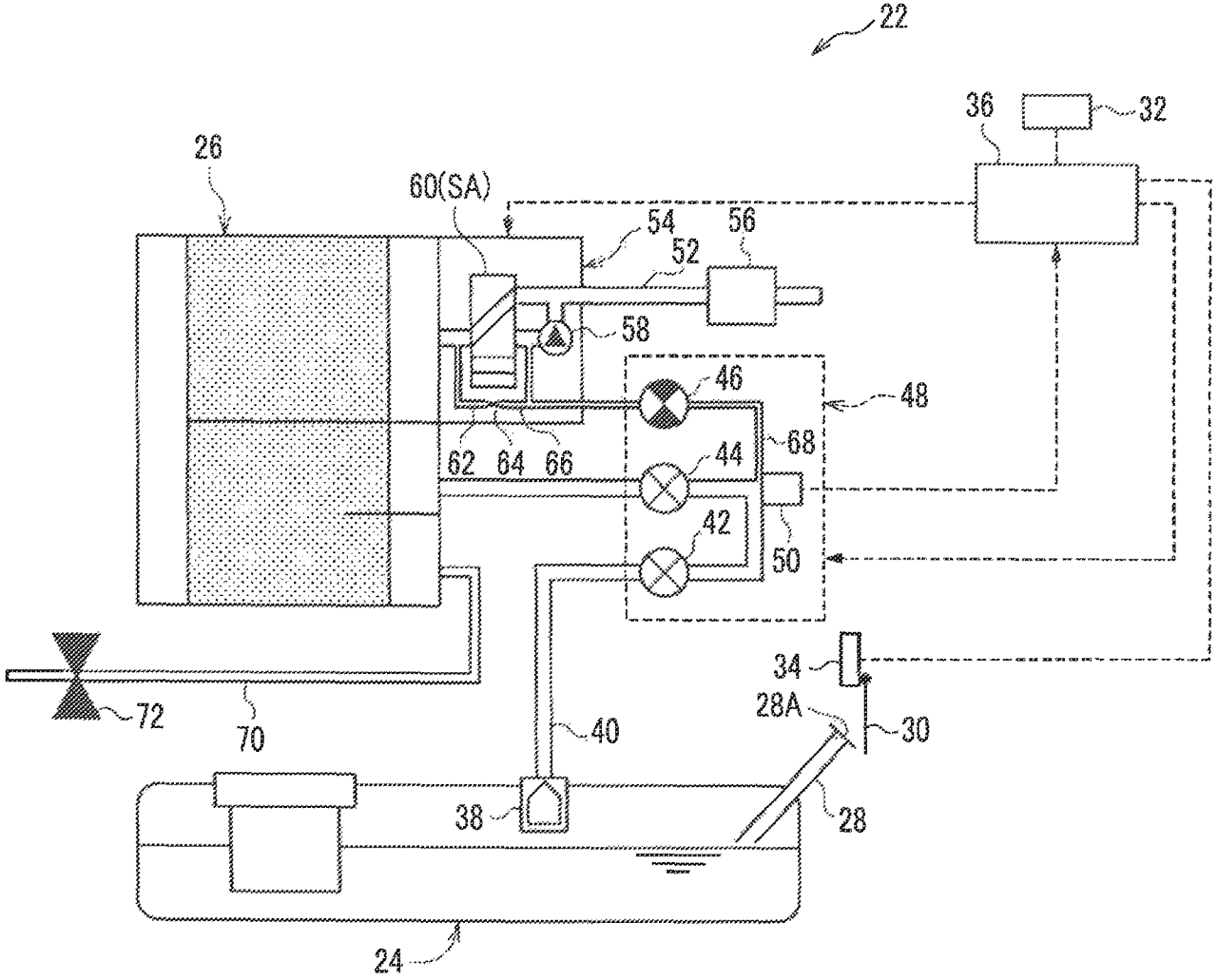
FIG. 2 is a configuration diagram illustrating the fuel tank system of the embodiment in a state at the time when the vehicle is traveling.

At the time when the vehicle traveling, the control method of the fuel tank system 22 in a case where the internal pressure of the fuel tank 24 is a positive pressure will be described with reference to FIGS. 2 and 3.

Figure 3:
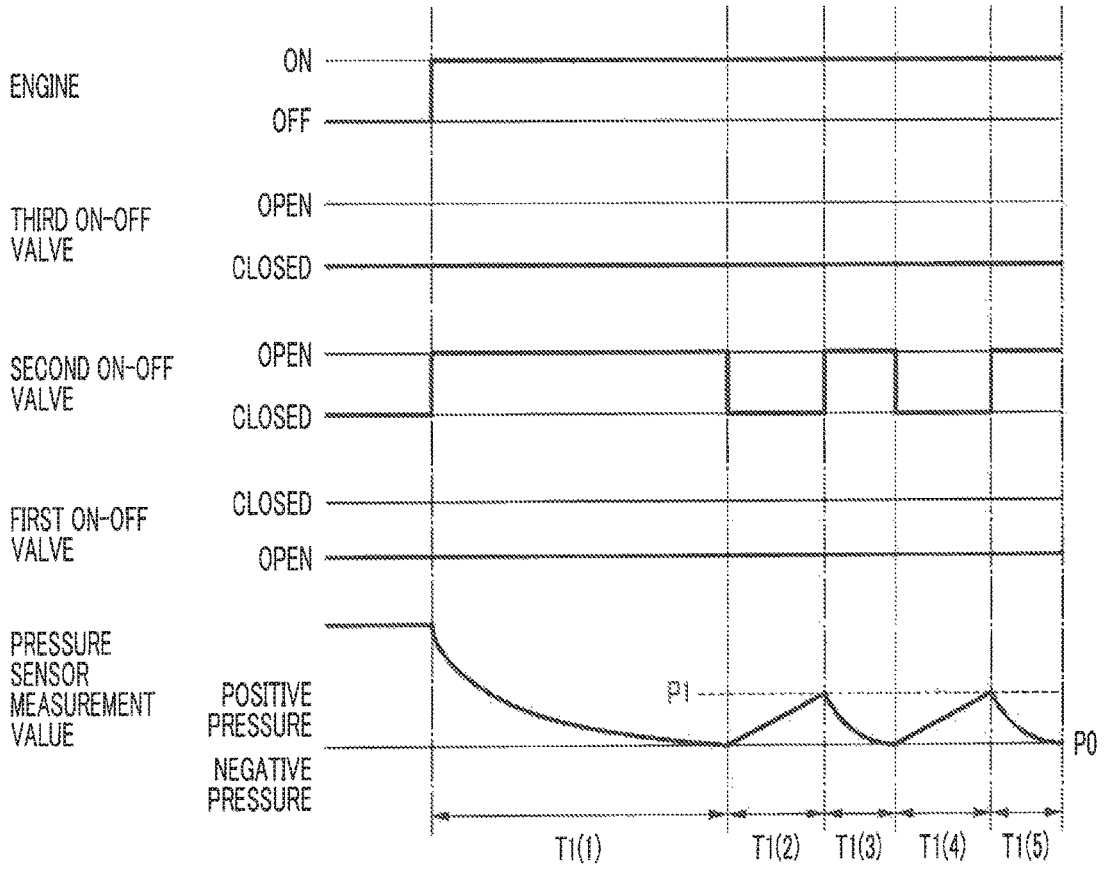
FIG. 3 is a chart showing the state of each member and the measurement of a pressure sensor in the fuel tank system of the embodiment at the time when the vehicle traveling with the lapse of time.

As illustrated in FIG. 3, in the control method at the time of traveling, the value of the pressure measured by the pressure sensor 50 is set to a predetermined threshold P1 (positive pressure). The example illustrated in FIG. 3 refers to a case where the pressure measured by the pressure sensor 50 exceeds the threshold P1 at the time of starting control.

When the engine is in an ON state, the control device 36 starts the control of the fuel tank system 22 at the time of traveling.

At the time of starting the control, in the case where the pressure measured by the pressure sensor 50 exceeds the threshold P1, the control device 36 opens the second on-off valve 44 as indicated by time T1(1) in FIG. 3. That is, the first on-off valve 42 and the second on-off valve 44 enter the open state and the third on-off valve 46 enters the closed state (see FIG. 2). Accordingly, the fuel tank 24 and the canister 26 communicate with each other through the vent line 40, and so-called "pressure relief" of the fuel tank 24 is started. Since the gas in the fuel tank 24 moves to the canister 26, the internal pressure of the fuel tank 24 decreases.

When the pressure sensor 50 detects that the internal pressure of the fuel tank 24 becomes the atmospheric pressure P0 or lower, the control device 36 closes the second on-off valve 44 as indicated by time T1(2) in FIG. 3 (see FIG. 1). The gas in the fuel tank 24 does not move to the canister 26, and the "pressure relief" is temporarily ended. Therefore, the internal pressure of the fuel tank 24 may increase again. However, when the internal pressure of the fuel tank 24 becomes the threshold P1 or higher, the control device 36 opens the second on-off valve 44 as indicated by time T1(3) in FIG. 3 and resumes the pressure relief, and thus the internal pressure of the fuel tank 24 decreases.

Thereafter, the operation of ending the pressure relief by closing the second on-off valve 44 as indicated by time T1(4) in FIG. 3, and the operation of performing the pressure relief by opening the second on-off valve 44 as indicated by time T1(5) in FIG. 3, are appropriately repeated. Accordingly, at the time when the vehicle traveling, the pressure relief of the fuel tank 24 is reliably performed. Therefore, an increase in the tank internal pressure to the threshold P1 or higher can be suppressed.

At Time of Refueling

The control method of the fuel tank system 22 at the time when the vehicle is refueled will be described with reference to FIG. 4. The example illustrated in FIG. 4 refers to a case where the pressure measured by the pressure sensor 50 at the time of starting the control is a positive pressure.

Figure 4:
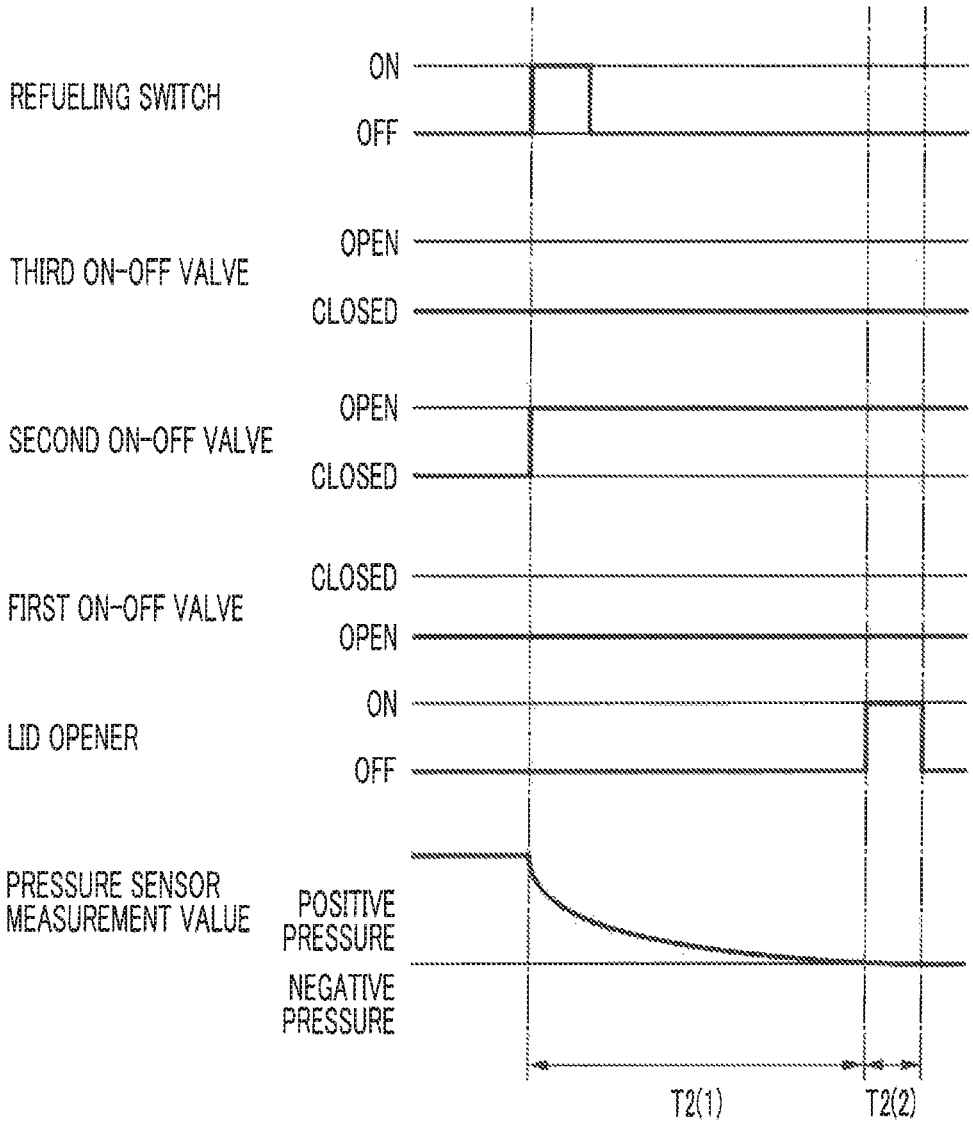
FIG. 4 is a chart showing the state of each member and the measurement of a pressure sensor in the fuel tank system of the embodiment at the time of refueling with the lapse of time.

When the refueling switch 32 enters the ON state, the control device 36 opens the second on-off valve 44 as indicated by time T2(1) in FIG. 4. That is, the first on-off valve 42 and the second on-off valve 44 enter the open state and the third on-off valve 46 enters the closed state (see FIG. 2). In this state, the control device 36 maintains the lid opener 34 in the OFF state such that the lid is locked in the closed position.

In addition, the fuel tank 24 and the canister 26 communicate with each other through the vent line 40, and the pressure relief of the fuel tank 24 is started. Since the gas in the fuel tank 24 moves to the canister 26, the internal pressure of the fuel tank 24 decreases.

When the internal pressure of the fuel tank 24 decreases to the atmospheric pressure, the control device 36 allows the lid opener 34 to be in the ON state as indicated by time T2(2) in FIG. 4. Accordingly, the lid 30 moves to the open position. Since the internal pressure of the fuel tank 24 becomes the atmospheric pressure, for example, when a refueling cap is removed, an overflow of the fuel in the fuel tank 24 is suppressed. In addition, by removing the refueling cap, the fuel tank 24 can be refueled.

At Time of Determining State

A control method of determining the state of the fuel tank system 22 will be described with reference to FIGS. 5 to 12. In the example illustrated in FIG. 5, pressure thresholds P2 (positive pressure), P3 (negative pressure) for determining a leakage in the fuel tank 24 are set in advance.

In the control method of determining the state of the fuel tank system 22, after a lapse of a predetermined time (for example, five hours) from the parking of the vehicle, the control device 36 enters an ON state and starts to determine the state of the fuel tank system 22. In addition, in a case where a malfunction in the fuel tank system 22 is detected while the state of the fuel tank system 22 is determined, the subsequent processing may be stopped. Alternatively, for example, the occurrence of the malfunction may be stored in the control device 36, and thereafter the subsequent processing may be performed. In the case where a malfunction in the fuel tank system 22 is detected, the specific contents of the malfunction are notified by a notification member (not illustrated) such as a display or voice.

Figure 5:
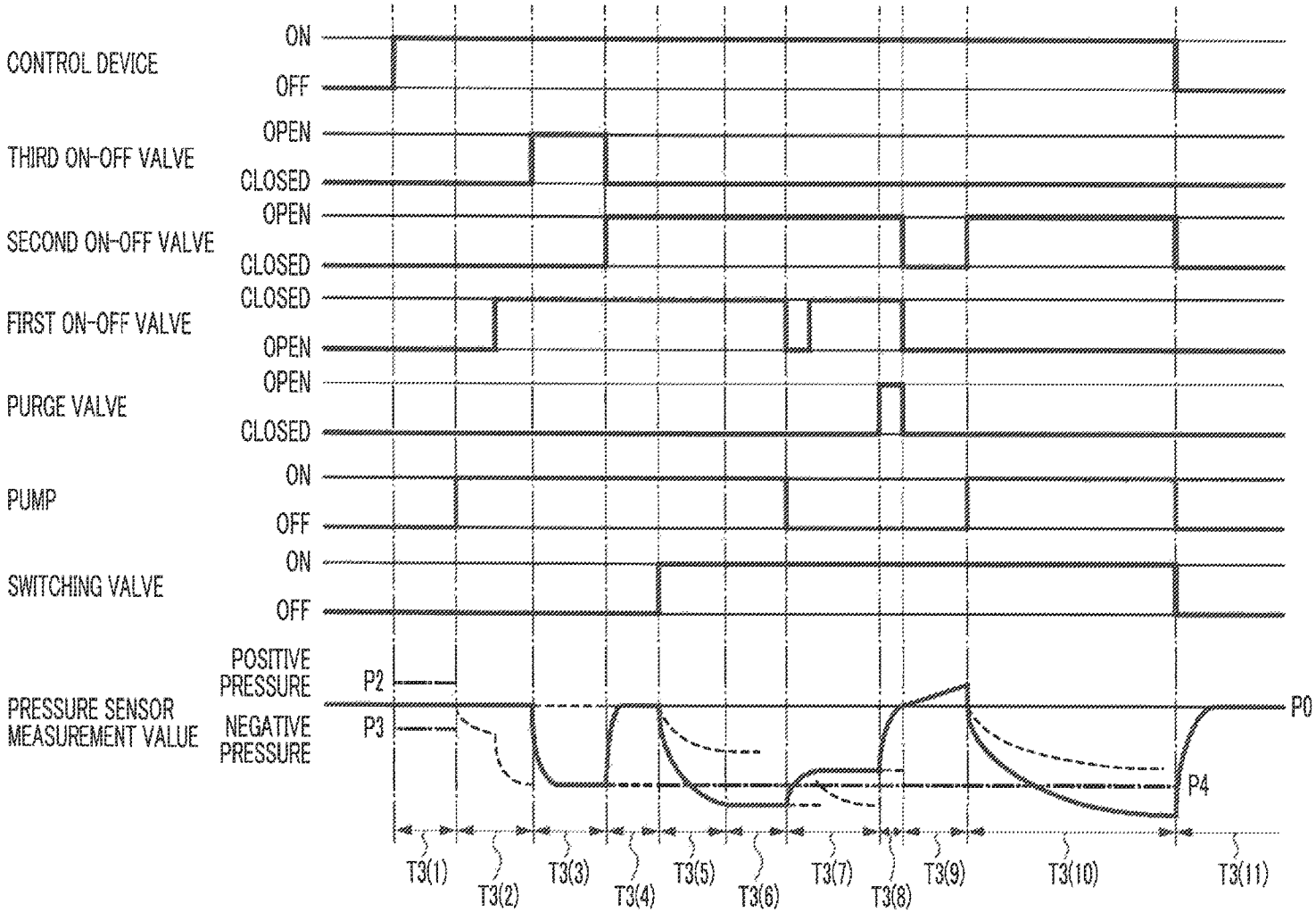
FIG. 5 is a chart showing the state of each member and the measurement of a pressure sensor in the fuel tank system of the embodiment at the time of state determination with the lapse of time.
Figure 6:
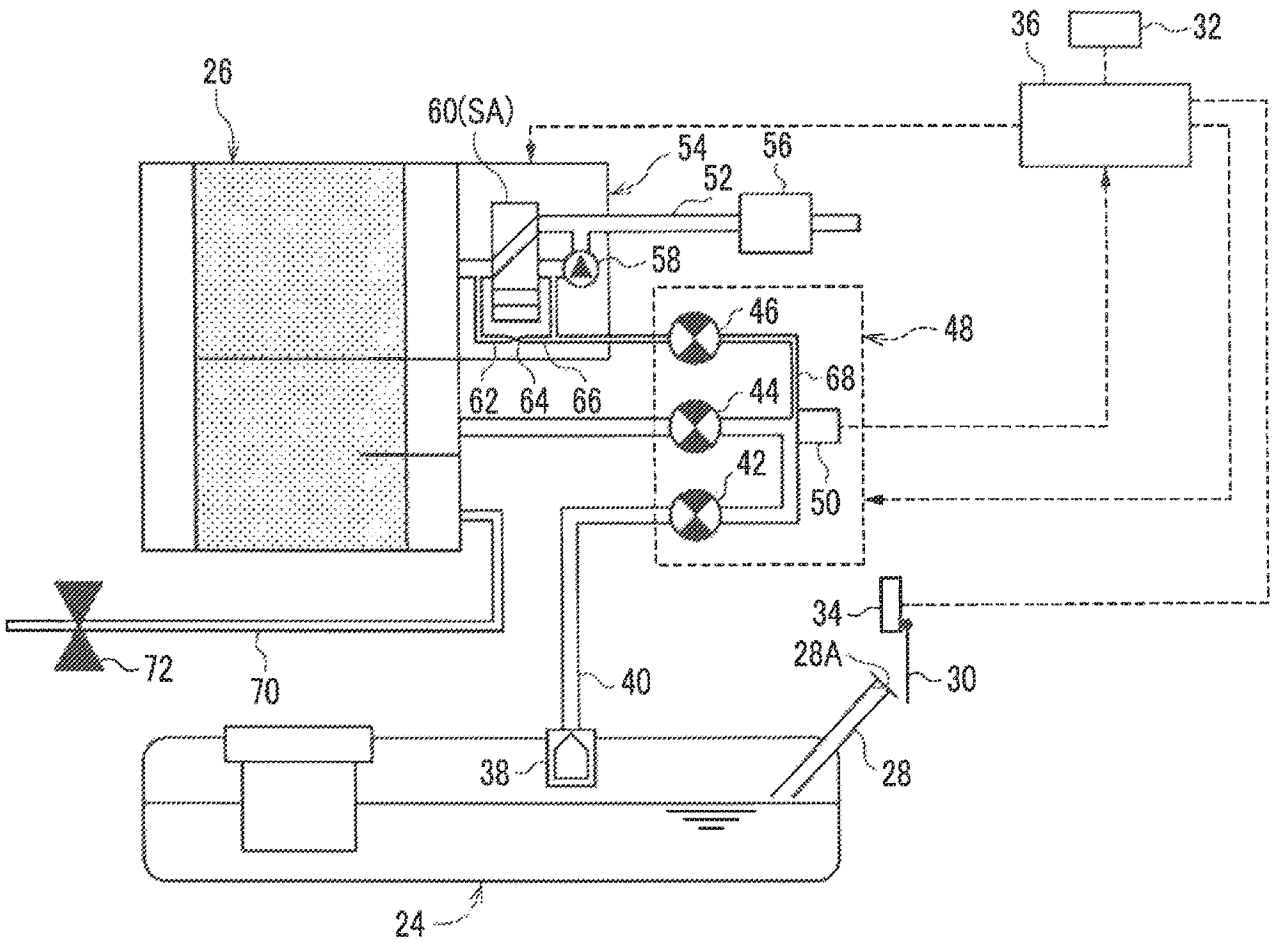
FIG. 6 is a configuration diagram illustrating the fuel tank system of the embodiment in a state at the time of state determination.
Figure 7:
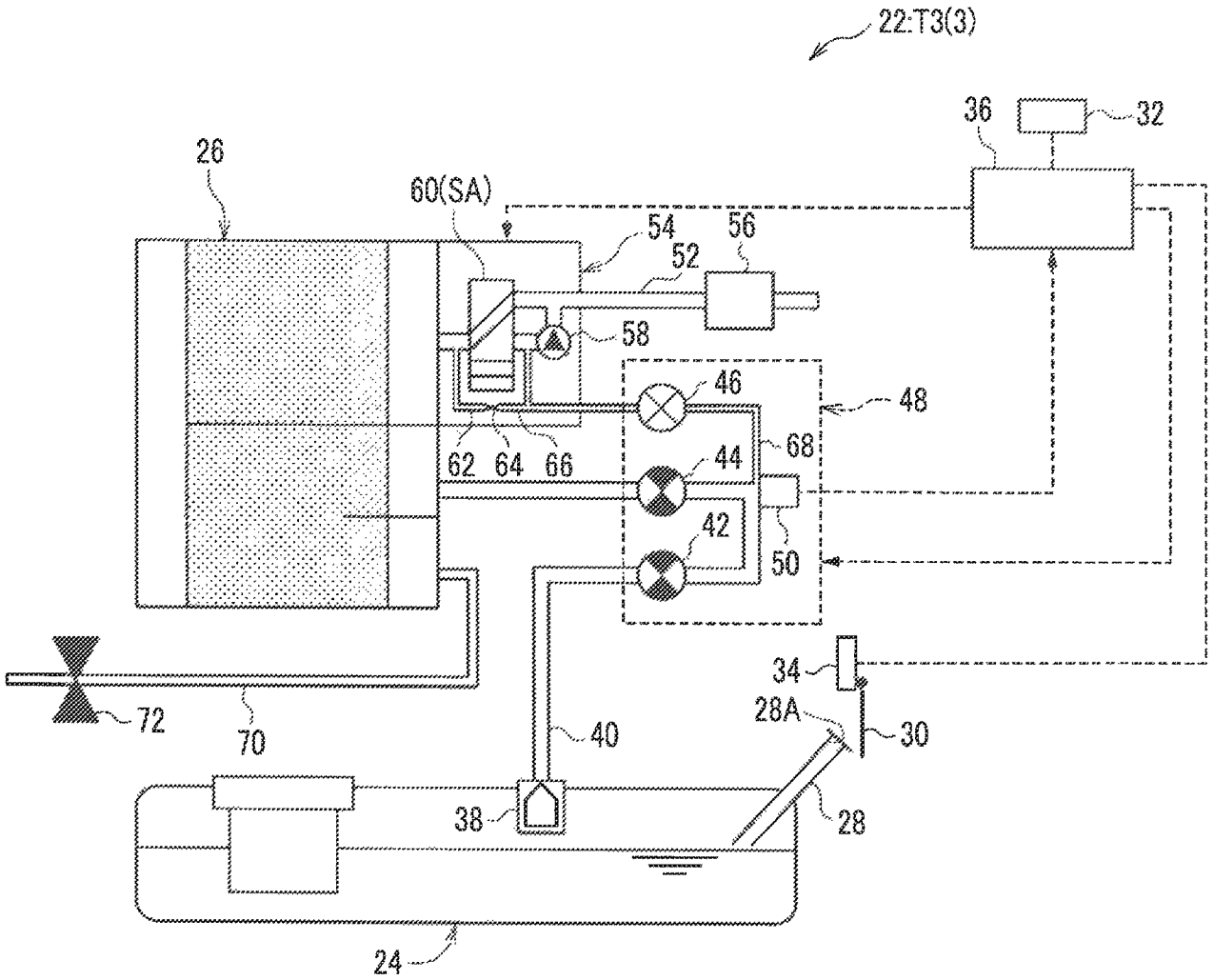
FIG. 7 is a configuration diagram illustrating the fuel tank system of the embodiment in a state at the time of state determination.

In FIG. 5, the pressure measured by the pressure sensor 50 is indicated by solid lines in a case where there is no malfunction in the fuel tank system 22 and is indicated by broken lines in a case where there is a malfunction.

After the control device 36 enters the ON state, the control device 36 maintains the state in which the first on-off valve 42 is open and the second on-off valve 44 and the third on-off valve 46 are closed during time T3(1) in FIG. 5 (see FIG. 1). Accordingly, the internal pressure of the fuel tank 24 is applied to the pressure sensor 50.

The control device 36 determines a leakage in the fuel tank 24 based on the pressure measured by the pressure sensor 50. Specifically, in a case where the internal pressure of the fuel tank 24 is higher than the threshold P2 or lower than the threshold P3, the internal pressure of the fuel tank 24 is maintained at a pressure that is significantly different from the atmospheric pressure P0. Therefore, the control device 36 determines that there is no leakage in the fuel tank 24.

Contrary to this, in a case where the internal pressure of the fuel tank 24 is equal to or lower than the threshold P2 and equal to or higher than the threshold P3, since the internal pressure of the fuel tank 24 is close to the atmospheric pressure P0, the control device 36 can determine that there is a possibility of a leakage in the fuel tank 24. Even in this case, there may be a case where there is no leakage in the fuel tank 24 as described later.

Next, as indicated by time T3(2) in FIG. 5, the control device 36 allows the pump 58 to be in an ON state and determines opening failure in the third on-off valve 46. In the following description, "opening failure" in each of the valves (the first on-off valve 42, the second on-off valve 44, and the third on-off valve 46) refers to a case where the valve is in an open state while having to be in a closed state. Similarly, "closing failure" in the valve refers to a case where the valve is in a closed state while having to be in an open state.

When the pump 58 is driven, a predetermined negative pressure is generated in the reference path 66. In a case where there is opening failure in the third on-off valve 46, since the first on-off valve 42 is open, the negative pressure is applied to the fuel tank 24 through the vent line 40 from the communication path 68. Therefore, as indicated by the broken line at time T3(2) in FIG. 5, the measurement value of the pressure sensor 50 (the internal pressure of the fuel tank 24) starts to decrease.

The control device 36 closes the first on-off valve 42 in the middle of time T3(2). That is, all the first on-off valve 42, the second on-off valve 44, and the third on-off valve 46 enter the closed state (see FIG. 6). Accordingly, the negative pressure of the pump 58 is not applied to the fuel tank 24. However, in a case where there is opening failure in the third on-off valve 46, the negative pressure of the pump 58 is not applied to the fuel tank 24, and is applied to a range of the communication path 68 and the vent line 40 closer to the pressure sensor 50 than the first on-off valve 42 and the second on-off valve 44, that is, an extremely narrow range. Therefore, the measurement value of the pressure sensor 50 sharply decreases due to the closing of the first on-off valve 42. As described above, the opening failure of the third on-off valve 46 can be more reliably determined by using a change in the measurement value of the pressure sensor 50 due to the opening of the first on-off valve 42.

In a case where the control device 36 determines at time T3(2) that there is no opening failure in the third on-off valve 46, as indicated by time T3(3), the control device 36 opens the third on-off valve 46 (see FIG. 7) and determines OFF failure in the pump 58. "OFF failure" in the pump 58 refers to a case where the pump 58 is in an OFF state while having to be in an ON state.

In a case where there is no OFF failure in the pump 58, the negative pressure of the pump 58 is applied to the pressure sensor 50 via the third on-off valve 46, so that the pressure measured by the pressure sensor 50 decreases within a short time as indicated by the solid line at time T3(3) in FIG. 5. In addition, since the pressure is stabilized at a predetermined negative pressure at which gas passes through the orifice 64, the control device 36 stores the pressure as the reference pressure P4. The reference pressure P4 is a pressure threshold in a case where a leakage in the canister 26 and a leakage in the entire fuel tank system 22 are determined.

Contrary to this, in a case where there is OFF failure in the pump 58, the negative pressure of the pump 58 is not generated, so that as indicated by the broken line at time T3(3) in FIG. 5, the measurement value of the pressure sensor 50 does not decrease and is maintained at the atmospheric pressure P0. In addition, even in a case where there is opening failure in the second on-off valve 44, since the second on-off valve 44 is in the open state, the measurement value of the pressure sensor 50 does not decrease. Even in a case where there is closing failure in the third on-off valve 46, since the third on-off valve 46 is in the closed state, the measurement value of the pressure sensor 50 does not decrease.

Figure 8:
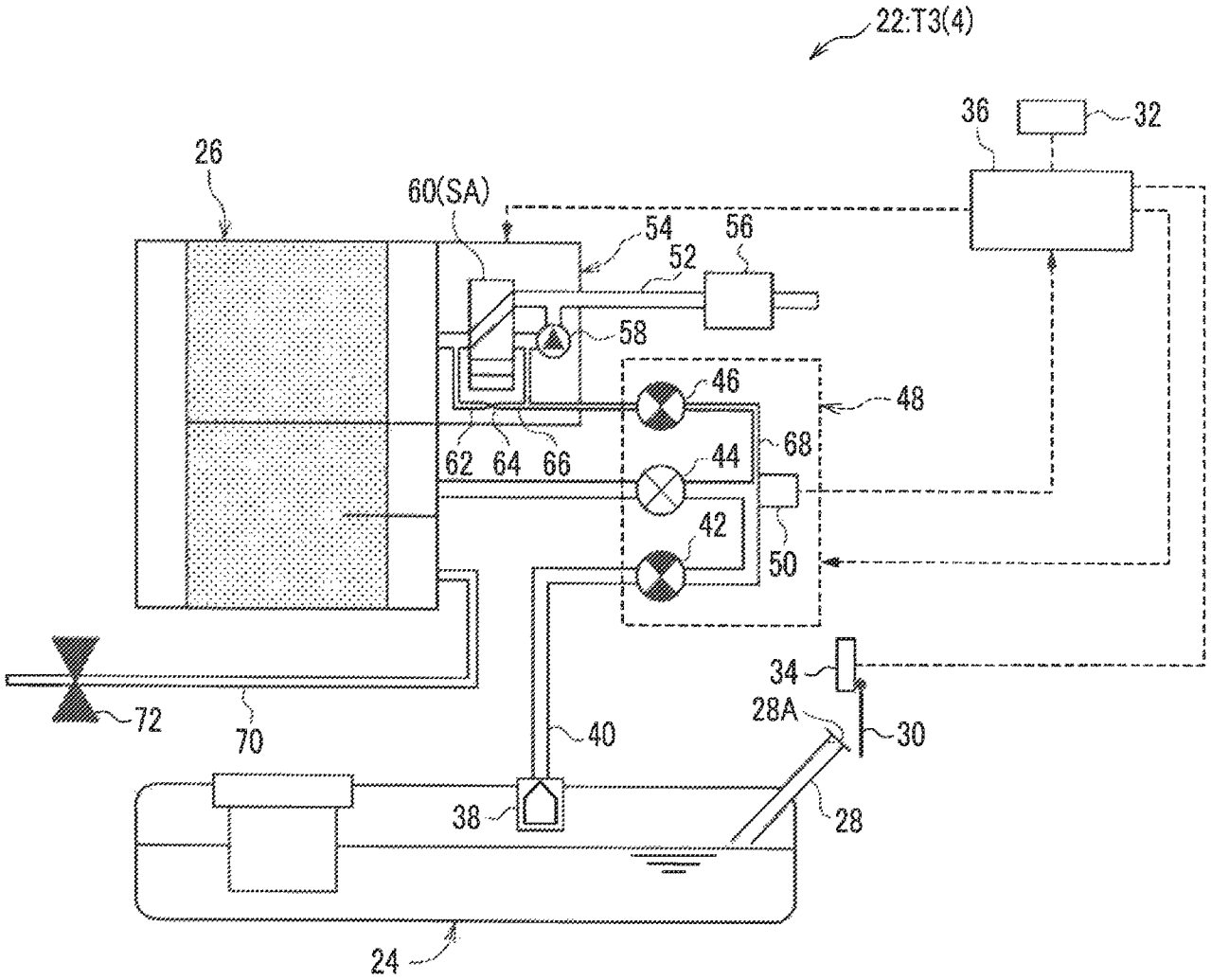
FIG. 8 is a configuration diagram illustrating the fuel tank system of the embodiment in a state at the time of state determination.

In a case where there is no OFF failure in the pump 58 (there is no opening failure in the second on-off valve 44 and there is no closing failure in the third on-off valve 46), as indicated by time T3(4) in FIG. 5, the control device 36 opens the second on-off valve 44 and closes the third on-off valve 46 (see FIG. 8). In addition, the control device 36 determines whether or not there is closing failure in the second on-off valve 44 and measures the atmospheric pressure.

That is, since the switching valve 60 is in the OFF state, in a case where there is no closing failure in the second on-off valve 44, the atmospheric pressure is applied to the pressure sensor 50 via the atmosphere communication pipe 52, the canister 26, and the vent line 40. The internal pressure of the canister 26 becomes the measurement value of the pressure sensor 50, and thus the measurement value of the pressure sensor 50 becomes the atmospheric pressure as indicated by the solid line at time T3(4) in FIG. 5.

Contrary to this, in a case where there is closing failure in the second on-off valve 44, the atmospheric pressure is not applied to the pressure sensor 50, so that as indicated by the broken line at time T3(4) in FIG. 5, the measurement value of the pressure sensor 50 is maintained at a low value (negative pressure). At time T3(4), the pump 58 may temporarily be in the OFF state.

In a case where there is no closing failure in the second on-off valve 44, as indicated by time T3(5) in FIG. 5, the control device 36 switches the switching valve 60 to the ON state (see FIG. 9) and determines whether or not there is OFF failure in the switching valve 60 and whether or not there is opening failure in the first on-off valve 42.

In a case where there is no OFF failure in the switching valve 60 or there is no opening failure in the first on-off valve 42, the negative pressure of the pump 58 is applied to the pressure sensor 50 via the canister 26 and the vent line 40. That is, the internal pressure of the canister 26 becomes the measurement value of the pressure sensor 50. However, the negative pressure of the pump 58 is not applied to the fuel tank 24. Therefore, as indicated by the solid line at time T3(5) in FIG. 5, the measurement value of the pressure sensor 50 decreases within a short time.

Contrary to this, in a case where there is OFF failure in the switching valve 60 and there is opening failure in the first on-off valve 42, the negative pressure of the pump 58 applied to the pressure sensor 50 is relatively low compared to that in the case where there is no OFF failure in the switching valve 60 and there is no opening failure in the first on-off valve 42. Therefore, as indicated by the broken line at time T3(5) in FIG. 5, a decrease in the measurement value of the pressure sensor 50 is gentler than in the case indicated by the solid line.

In a case where there is no OFF failure in the switching valve 60 and there is no opening failure in the first on-off valve 42, the control device 36 continuously determines whether or not there is a leakage in the canister 26. Even in this case, the internal pressure of the canister 26 becomes the measurement value of the pressure sensor 50. That is, in a case where there is no leakage in the canister 26, the negative pressure does not leak from the canister 26, so that the measurement value of the pressure sensor 50 is maintained at a constant value that is lower than a system leakage determination value as indicated by the solid line at time T3(6) in FIG. 5. Contrary to this, when there is a leakage in the canister 26, the negative pressure leaks from the canister 26, so that the measurement value of the pressure sensor 50 increases and becomes higher than, for example, the system leakage determination value.

In a case where there is no leakage in the canister 26, as indicated by time T3(7) in FIG. 5, the control device 36 stops the pump 58. In addition, the control device 36 determines whether or not there is a closing failure in the first on-off valve 42 and whether or not there is ON failure in the pump 58 by temporarily opening the first on-off valve 42 (see FIG. 10) and closing the first on-off valve 42 again within a short time (see FIG. 9).

That is, in a case where there is no closing failure in the first on-off valve 42, when the first on-off valve 42 is temporarily opened, the fuel tank 24 temporarily communicates with the atmosphere via the vent line 40, the canister 26, and the atmosphere communication pipe 52, so that the measurement value of the pressure sensor 50 temporarily increases as indicated by the solid line at time T3(7) in FIG. 5. In addition, by closing the first on-off valve 42 again, the measurement value of the pressure sensor 50 does not further increase and is maintained at a constant value.

Contrary to this, when there is closing failure in the first on-off valve 42, the first on-off valve 42 is not reliably opened even when the first on-off valve 42 is temporarily opened, so that the measurement value of the pressure sensor 50 is maintained at a constant value as indicated by the broken line in the former half of time T3(7) in FIG. 5. In addition, when there is ON failure in the pump 58, a negative pressure is generated in the pump 58, so that the negative pressure is applied to the pressure sensor 50 in the state in which the first on-off valve 42 is closed again. As indicated by the broken line in the latter half of time T3(7) in FIG. 5, the measurement value of the pressure sensor 50 decreases.

In a case where there is no closing failure in the first on-off valve 42 and there is no ON failure in the pump 58, the control device 36 temporarily opens the purge valve 72 (see FIG. 11) and determines whether or not there is closing failure in the purge valve 72 as indicated by time T3(8) in FIG. 5. That is, in a case where there is no closing failure in the purge valve 72, the pressure of the engine is applied to the pressure sensor 50 via the purge pipe 70, the canister 26, and the vent line 40.

Control to detect the state of the fuel tank system 22 is performed after a lapse of a predetermined time from the parking of the vehicle as described above. Therefore, in a case where there is no closing failure in the purge valve 72, the pressure applied to the pressure sensor 50 from the engine increases to the atmospheric pressure as indicated by the solid line at time T3(8) in FIG. 5. Contrary to this, when there is closing failure in the purge valve 72, since the pressure sensor 50 is not open to the atmosphere, the measurement value of the pressure sensor 50 does not decrease and is maintained at a constant value as indicated by the broken line at time T3(8) in FIG. 5.

Next, as indicated by time T3(9) in FIG. 5, the control device 36 may perform control to close the second on-off valve 44 and open the first on-off valve 42. In a case where evaporative fuel is generated in the fuel tank 24, the measurement value of the pressure sensor 50 increases. In addition, the amount of evaporative fuel generated in the fuel tank 24 can be measured from the pressure increase value. In a case where the pressure measured by the pressure sensor 50 excessively increases, the control may be ended without performing the subsequent processing.

Furthermore, as indicated by time T3(10) in FIG. 5, the control device 36 opens the second on-off valve 44 and determines whether or not there is a leakage in the entire fuel tank system 22 by driving the pump 58. Since the negative pressure of the pump 58 is applied to the fuel tank 24 from the canister 26 via the vent line 40, when there is no leakage in the entire fuel tank system 22, as indicated by the solid line at time T3(10) in FIG. 5, the measurement value of the pressure sensor 50 becomes lower than the reference pressure P4 (system leakage determination value). Contrary to this, when there is a leakage from any portion of the fuel tank system 22, as indicated by the broken line at time T3(10) in FIG. 5, a decrease in the pressure becomes gentle and does not reach the reference pressure P4 (system leakage determination value).

After whether or not there is a leakage in the entire fuel tank system 22 is determined in this manner, the control device 36 enters the OFF state and ends the control to detect the state of the fuel tank system 22.

In addition, in a case where the detection of a leakage in the fuel tank 24 and the canister 26 and the detection of the states of the first on-off valve 42, the second on-off valve 44, the third on-off valve 46, the switching valve 60, and the purge valve 72 are reliably performed by the control at times T3(1) to T3(8), the control at times T3(9) and T3(10) can be omitted.

However, for example, in a case where the internal pressure of the fuel tank 24 is equal to or lower than the threshold P2 and equal to or higher than the threshold P3, there may be a case where whether or not there is a leakage in the fuel tank 24 cannot be determined solely by performing the control at times T3(1) to T3(8). For example, there is a case where the internal pressure of the fuel tank 24 occasionally becomes equal to or lower than the threshold P2 and equal to or higher than the threshold P3 despite the fact that there is no leakage in the fuel tank 24. Assuming such a case, it is possible to reliably determine a leakage in the fuel tank system 22 by performing the control at times T3(9) and T3(10).

Thereafter, as indicated by time T3(11) in FIG. 5, the control device 36 enters the OFF state. The first on-off valve 42 enters the open state, and the second on-off valve 44, the third on-off valve 46, and the purge valve 72 enter the closed states. Furthermore, the switching valve 60 and the pump 58 enter the OFF states.

As can be understood from the description, in the embodiment, whether or not there is a leakage in the fuel tank system 22 including the fuel tank 24 and the canister 26 can be determined with the structure having the single pressure sensor 50. There is no need to provide a plurality of pressure sensors, and a simple structure is provided.

In addition, in the embodiment, in a case where the determination of the state of the fuel tank system 22 is not performed (at the time of parking, traveling, and refueling of the vehicle), the opening and closing of the second on-off valve 44 is controlled while the open state of the first on-off valve 42 and the closed state of the third on-off valve 46 are maintained. Accordingly, control to appropriately adjust the internal pressure of the fuel tank 24 or the amount of gas (including evaporative fuel) moving from the fuel tank 24 to the canister 26 can be performed.

In the embodiment, the first on-off valve 42, the second on-off valve 44, and the third on-off valve 46 are integrated as one body by the integrated valve 48. Compared to a structure in which the first on-off valve 42, the second on-off valve 44, and the third on-off valve 46 are separate bodies, the substantial number of parts is small.

In the description, an example in which the relative pressure sensor is used as the pressure sensor 50 is adopted. However, the pressure sensor 50 may also be an absolute pressure sensor. In the case where the pressure sensor 50 is an absolute pressure sensor, for example, the pressure value measured at time T3(1) in FIG. 5 is stored in the control device 36, the atmospheric pressure is measured at time T3(4), and a leakage in the fuel tank 24 can be determined by comparing the measured pressure value and the atmospheric pressure to each other.

The operation of obtaining the reference pressure (system leakage determination value) can also be performed at a time other than time T3(3). For example, during the control at time T3(8) and the control at time T3(9), that is, in the state in which the pressure measured by the pressure sensor 50 becomes the atmospheric pressure, the same control as the control performed at time T3(3) may be performed to obtain the reference pressure (system leakage determination value). In addition, whether or not there is a leakage in the canister 26 can be determined by comparing the reference pressure to the pressure measured by the pressure sensor 50 at time T3(6). Particularly, since the difference between the time at which the pressure is measured at time T3(6) and the time at which the reference pressure is obtained is short, it is possible to more reliably determine whether or not there is a leakage in the canister 26.

Similarly, in the state in which the pressure measured by the pressure sensor 50 at time T3(11) becomes the atmospheric pressure, the same control as the control performed at time T3(3) may be performed to obtain the reference pressure (system leakage determination value). In addition, whether or not there is a leakage in the fuel tank system 22 can be determined by comparing the reference pressure to the pressure measured by the pressure sensor 50 at time T3(10). Even in this case, since the difference between the time at which the pressure is measured at time T3(10) and the time at which the reference pressure is obtained is short, it is possible to more reliably determine whether or not there is a leakage in the fuel tank system 22.

Each operation shown in FIG. 5 can be replaced as appropriate. For example, immediately after the start of the determination of the state of the fuel tank system 22, first, as in the operation indicated by time T3(10), whether or not there is a leakage in the entire fuel tank system 22 may be determined.

What is claimed is:

1. A fuel tank system comprising:

a fuel tank configured to store a fuel;

a canister configured to cause an evaporative fuel to adsorb or desorb using an adsorbent;

a first path configured to be connected to the canister and cause an inside of the canister to communicate with an atmosphere;

a pump configured to be disposed in a second path connected to the canister and apply a pressure to the canister;

a switching device configured to be selectively switched between an atmosphere communication state in which the canister communicates with the atmosphere using the first path and a pressure introduction state in which the pressure of the pump is applied to the canister using the second path and the pump;

a reference path configured to be connected to the canister and the pump, have a resistance portion having a locally high flow resistance, and cause an air to be introduced into the canister through the resistance portion by driving the pump when the switching device is switched to the atmosphere communication state;

a first on-off valve configured to be disposed in a vent line that causes the fuel tank and the canister to communicate with each other and open and close the vent line;

a second on-off valve configured to be disposed in the vent line at a position closer to the canister than the first on-off valve and open and close the vent line;

a third on-off valve configured to be disposed in a communication path that causes the vent line between the first on-off valve and the second on-off valve and the reference path to communicate with each other and open and close the communication path;

a pressure sensor disposed in the vent line between the first on-off valve and the second on-off valve or in the communication path closer to the vent line than the third on-off valve; and a control device configured to control the pump, the switching device, the first on-off valve, the second on-off valve, and the third on-off valve and determine a system state based on a pressure measured by the pressure sensor.

2. The fuel tank system according to claim 1, wherein the first on-off valve, the second on-off valve, and the third on-off valve are configured as an integrated valve that is integrated.

3. A control method of a fuel tank system including a fuel tank, a canister, a first path, a pump, a switching device, a reference path, a first on-off valve, a second on-off valve, a third on-off valve, a pressure sensor, and a control device, the fuel tank being configured to store a fuel, the canister being configured to cause an evaporative fuel to adsorb or desorb using an adsorbent, the first path being configured to be connected to the canister and cause an inside of the canister to communicate with an atmosphere, the pump being configured to be disposed in a second path connected to the canister and apply a pressure to the canister, the switching device being configured to be selectively switched between an atmosphere communication state in which the canister communicates with the atmosphere using the first path and a pressure introduction state in which the pressure of the pump is applied to the canister using the second path and the pump, the reference path being configured to be connected to the canister and the pump, have a resistance portion having a locally high flow resistance, and cause an air to be introduced into the canister through the resistance portion by driving the pump when the switching device is switched to the atmosphere communication state, the first on-off valve being configured to be disposed in a vent line that causes the fuel tank and the canister to communicate with each other and open and close the vent line, the second on-off valve being configured to be disposed in the vent line at a position closer to the canister than the first on-off valve and open and close the vent line, the third on-off valve being configured to be disposed in a communication path that causes the vent line between the first on-off valve and the second on-off valve and the reference path to communicate with each other and open and close the communication path, the pressure sensor being disposed in the vent line between the first on-off valve and the second on-off valve or in the communication path closer to the vent line than the third on-off valve, the control device being configured to control the pump, the switching device, the first on-off valve, the second on-off valve, and the third on-off valve and determine a system state based on a pressure measured by the pressure sensor, the control method comprising:

by the control device, measuring an internal pressure of the fuel tank using the pressure sensor by controlling the first on-off valve to be in an open state and controlling the second on-off valve and the third on-off valve to be in a closed state; and by the control device, measuring an internal pressure of the canister using the pressure sensor by controlling the second on-off valve to be in an open state, controlling the first on-off valve to be in a closed state, controlling the switching device to be switched to the pressure introduction state, and controlling the pump to be driven.

4. The control method according to claim 3, further comprising, by the control device, controlling opening and closing of the second on-off valve in a state in which the first on-off valve is open and the third on-off valve is closed at the time when the fuel tank is refueled and at the time when a vehicle on which the fuel tank system is provided is parked or traveling.

5. The control method according to claim 3, further comprising, by the control device, controlling the pump to be driven by causing the switching device to enter the atmosphere communication state in a state in which the second on-off valve and the third on-off valve are closed, and determining failure in a case where a pressure change occurs at a predetermined time.

6. The control method according to claim 3, further comprising, by the control device, controlling the switching device to enter the atmosphere communication state in a state in which the first on-off valve and the third on-off valve are closed and the second on-off valve is open, and determining failure in a case where there is no pressure change at a predetermined time.

7. The control method according to claim 3, further comprising, by the control device, controlling the pump to be driven by causing the switching device to enter the pressure introduction state in a state in which the first on-off valve and the third on-off valve are closed and the second on-off valve is open, and determining failure in a case where a gradient of a pressure change at a predetermined time is smaller than a predetermined gradient.

8. The control method according to claim 3, further comprising, by the control device, controlling the pump to be stopped by switching the switching device to the pressure introduction state in a state in which the first on-off valve and the second on-off valve are open, and determining failure in a case where there is no pressure change at a predetermined time.

* * * * *